US009316358B2

(12) United States Patent
Shih

(10) Patent No.: US 9,316,358 B2
(45) Date of Patent: Apr. 19, 2016

(54) SYSTEM FOR DETECTING AND DETERMINING THE TYPE OF AN INFLATABLE DEVICE BEING COUPLED WITH AN AIR SUPPLY DEVICE

(71) Applicant: CAREMED SUPPLY INC., New Taipei (TW)

(72) Inventor: Pao Ming Shih, Taipei (TW)

(73) Assignee: CAREMED SUPPLY INC., New Taipei (TW)

( * ) Notice: Subject to any disclaimer, the term of this patent is extended or adjusted under 35 U.S.C. 154(b) by 461 days.

(21) Appl. No.: 13/854,700

(22) Filed: Apr. 1, 2013

(65) Prior Publication Data

US 2014/0290795 A1 Oct. 2, 2014

(51) Int. Cl.

| | |
|---|---|
| ***F17C 13/02*** | (2006.01) |
| ***F17C 13/00*** | (2006.01) |
| ***A61H 9/00*** | (2006.01) |

(52) U.S. Cl.

CPC ..... *F17C 13/003* (2013.01); *A61H 9/0078* (2013.01); *A61H 2201/164* (2013.01); *A61H 2201/5002* (2013.01); *A61H 2201/5071* (2013.01); *A61H 2209/00* (2013.01)

(58) Field of Classification Search

CPC ..... F17C 13/003; F16L 39/00; F16L 37/00; F16L 37/08; F16L 37/0847; F16L 37/096; F16L 37/098; F16L 37/12; A61H 9/0078; A61H 2209/00; A61H 2201/5002; A61H 2201/5071

USPC ..... 141/94, 95; 601/151, 152; 602/13; 5/655.3

See application file for complete search history.

(56) References Cited

U.S. PATENT DOCUMENTS

| | | | | |
|---|---|---|---|---|
| 5,342,285 | A * | 8/1994 | Dye | 601/151 |
| 5,478,119 | A * | 12/1995 | Dye | 285/26 |
| 7,591,796 | B1 * | 9/2009 | Barak et al. | 601/152 |
| 7,771,376 | B2 * | 8/2010 | Roth et al. | 601/152 |
| 2004/0054306 | A1 * | 3/2004 | Roth et al. | 601/152 |
| 2005/0159690 | A1 * | 7/2005 | Barak et al. | 601/149 |
| 2005/0187500 | A1 * | 8/2005 | Perry et al. | 601/152 |
| 2011/0094040 | A1 * | 4/2011 | deGreef | A61G 7/05776 5/713 |
| 2012/0049508 | A1 * | 3/2012 | Liu | 285/33 |
| 2013/0147185 | A1 * | 6/2013 | Tsao | 285/120.1 |
| 2014/0094726 | A1 * | 4/2014 | Malhi et al. | 601/152 |

* cited by examiner

*Primary Examiner* — Timothy L Maust
*Assistant Examiner* — Andrew St. Clair
(74) *Attorney, Agent, or Firm* — Rabin & Berdo, P.C.

(57) ABSTRACT

A system for detecting and determining the type of an inflatable device being coupled with an air supply device is disclosed. The inflatable device includes an inflatable unit connected to a connector via an air delivery line. The air supply device includes a pressurized air supply unit and a pressure detection unit connected to a coupler. The connector is coupled with the coupler via several air inlet pipes. One of the air inlet pipes is a blocked pipe, a relative position of which on the connector varies with the type of the inflatable unit. The pressure detection unit determines the inflatable unit type by detecting the relative position of the blocked air inlet pipe, and the pressurized air supply unit supplies air of suitable pressure to the inflatable unit according to the type thereof, enabling the inflatable unit to properly massage a user's muscles to improve the blood circulation thereof.

13 Claims, 7 Drawing Sheets

SYSTEM FOR DETECTING AND DETERMINING THE TYPE OF AN INFLATABLE DEVICE BEING COUPLED WITH AN AIR SUPPLY DEVICE

FIELD OF THE INVENTION

The present invention relates to a system for detecting and determining the type of an inflatable device being coupled with an air supply device, and more particularly to a detection system for controlling the internal air pressure of an inflatable unit by providing recognition means on a connection assembly between an air supply device and the inflatable unit, and obtaining a detection result from the air supply device for determining the type of the inflatable unit and supplying air of suitable air pressure to the inflatable unit.

BACKGROUND OF THE INVENTION

A bedridden patient, such as a patient who is unable to conveniently move by himself or a patient who just undergoes a surgery, is subjected to slowed blood circulation and accordingly, blood clots, edema or vein thrombosis due to bad blood circulation of limbs, which are farther from the heart. In some worse cases, the bedridden patient is even subjected to necrotic tissue in their limbs.

There is a pneumatic inflatable device currently commercially available in the market for attaching to different body areas. When it is attached to a patient's specific body area and alternatively inflated and deflated by an inflating motor, the pneumatic inflatable device functions to massage and exercise the patient's muscles beneath it to thereby improve the patient's blood circulation.

It is noted the patient's muscles at different body areas require different levels of massaging and exercising. Therefore, a specific air pressure value must be set for the inflating motor each time it is used to inflate and produce an internal air pressure in the pneumatic inflatable device for massaging and exercising a specific body area. It is possible the inflating motor is wrongly set to an unsuitable air pressure value, and it is apparently troublesome and inconvenient for a user to change the setting of the inflating motor each time it is to be used.

In view of the disadvantages in the existing pneumatic inflatable device, it is desirable to develop a system for detecting and determining the type of an inflatable device being currently coupled with an air supply device, so that, when the inflating motor inflates a pneumatic inflatable device, the system automatically detects and determines the body area to which the pneumatic inflatable device is currently attached for use, and then automatically controls the level of air pressure to be supplied to the pneumatic inflatable device. With these arrangements, the pneumatic inflatable device is more convenient for use.

SUMMARY OF THE INVENTION

A primary object of the present invention is to provide a system for detecting and determining the type of an inflatable device being coupled with an air supply device. When the air supply device supplies air to inflate an inflatable unit of, for example, a pneumatic inflatable device coupled therewith, the system automatically detects and determines the type of the inflatable unit and automatically regulates the pressure of the air being supplied to the inflatable unit, so that the inflatable unit provides proper pressure to massage and exercise a user's selected body area and improve the blood circulation thereof to avoid the occurrence of blood clots and edema.

To achieve the above and other objects, the system for detecting and determining the type of an inflatable device being coupled with an air supply device according to the present invention includes an inflatable device and an air supply device. The inflatable device includes at least one air delivery line, an inflatable unit connected to one of two ends of each air delivery line, and a connector connected to the other end of each air delivery line and being a connecting end having a plurality of air inlet pipes provided on an axial end thereof opposite to the air delivery line. The air supply device internally includes a pressurized air supply unit and a pressure detection unit, and externally includes a coupler adapted to connect with the pressurized air supply unit and the pressure detection unit. The coupler is provided on an axial end with a plurality of coupling pipes for the air inlet pipes of the connector to correspondingly fit therein and constitutes a coupling end corresponding to the connecting end formed by the connector.

The inflatable unit is differently configured according to a usage type thereof, and one of the air inlet pipes on the connector is a blocked pipe while all other air inlet pipes are open pipes. The position of the blocked air inlet pipe relative to other open pipes of the connector varies with the type of the inflatable unit connected to the connector via the air delivery line, and the pressure detection unit detects the relative position of the blocked air inlet pipe on the connector to determine the exact type of the inflatable unit of the inflatable device being currently coupled with the air supply device.

In a preferred embodiment of the present invention, the connector further includes a housing member internally defining an air space, which is communicable with the air inlet pipes located at an axial end of the housing member, and at least one air outlet pipe located at another axial end of the housing member for connecting with the other end of the at least one air delivery line. In the preferred embodiment, the air outlet pipe is formed on a cap, and the cap is covered onto the other axial end of the housing member, so that air supplied into the air space can flow out of the air space only via the air outlet pipe. Since there is only one blocked air inlet pipe while all other air inlet pipes are open pipes on the connector, the pressure detection unit can determine the exact type of the inflatable unit by detecting the relative position of the blocked air inlet pipe on the connector.

The coupler further includes a chamber shaped corresponding to the housing member for holding the latter therein. The chamber internally defines a receiving space, of which two axial ends respectively form an open end and a fixing end, and the coupling pipes is spaced on the fixing end. The coupling pipes respectively have a diameter-expanded seat section and a diameter-reduced air path section. The air inlet pipes of the connector are fitted in the seat sections of the coupling pipes, and are provided on around respective distal end with an annular groove for receiving a sealing element therein to ensure tight fitting of the air inlet pipes in the coupling pipes.

To provide an increased connecting force between the connector and the coupler, the housing member of the connector is provided on each of two axial lateral outer surfaces with an elongated retaining arm, which has a proximal end connected to the lateral outer surface of the housing member and a free distal end formed into a hook portion and a push portion, and the chamber of the coupler has a channel and a retaining hole sequentially provided on each of two axial lateral inner surfaces thereof at positions corresponding to a linear path, along which the retaining arm is moved into the coupler.

Further, the housing member is provided on an outer surface with at least one guide rail, and the chamber is provided on a corresponding inner surface with a guide groove for correspondingly engaging with the guide rail to ensure that the connector only fits one way into the coupler. The chamber further has a raised portion formed on an outer surface thereof corresponding to each guide groove provided on the chamber's inner surface, and the housing member further has an extended portion formed on around the other axial end adjacent to the air outlet pipe, so that a user may conveniently determine from the outer appearances of the detachably connectable connector and coupler the only correct direction in which the connector can be fitted into the coupler.

The present invention is characterized in the forming of a plurality of blocked and open air inlet pipes on the connector of the inflatable device, so that the type of the inflatable unit connected to the connector can be determined by detecting the relative position of the blocked air inlet pipe on the connector via a pressure detection when the supplied air flows from the coupler toward the connector. According to the detected result, the pressurized air supply unit further controls the volume and pressure of air to be supplied to the inflatable unit.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
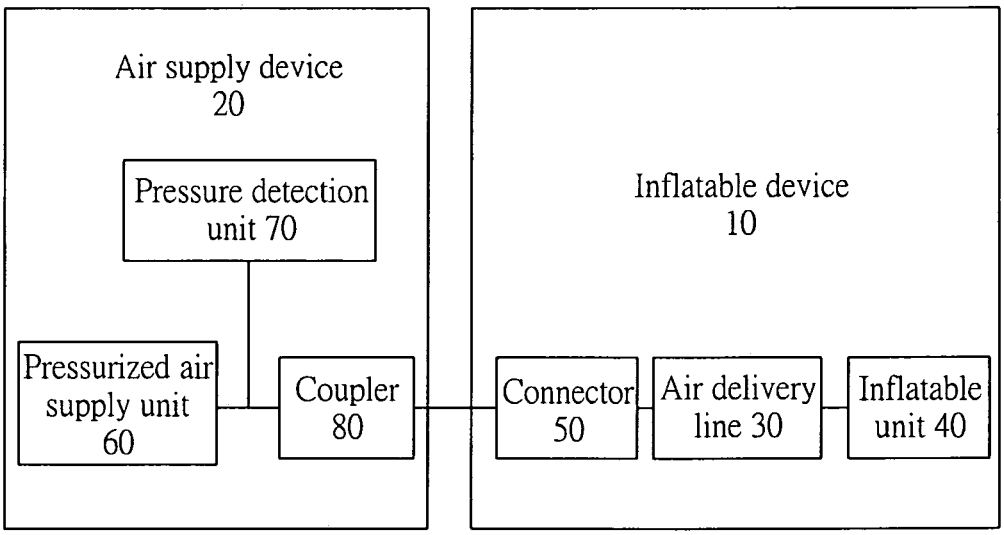
FIG. 1 is a block diagram of a system for detecting and determining the type of an inflatable device being coupled with an air supply device according to the present invention.

The present invention will now be described with some preferred embodiments thereof and with reference to the accompanying drawings. For the purpose of easy to understand, elements that are the same in the preferred embodiments are denoted by the same reference numerals.

Please refer to FIG. 1 that is a block diagram of a system for detecting and determining the type of an inflatable device being coupled with an air supply device according to the present invention. For the purpose of conciseness and clarity, the present invention is also briefly referred to as "the system" herein. As shown, the system according to the present invention includes an inflatable device 10 and an air supply device 20. The inflatable device 10 includes at least one air delivery line 30, which has two opposite ends and can be any hose-like member for delivering gas, such as air; an inflatable unit 40 connected to one end of every air delivery line 30; and a connector 50 to which the other end of every air delivery line 30 is connected. In this case, the connector 50 constitutes a connecting head having a plurality of air inlet pipes 51 (see FIG. 2).

The air supply device 20 internally includes a pressurized air supply unit 60 and a pressure detection unit 70, and externally includes a coupler 80 adapted to connect with the pressurized air supply unit 60 and the pressure detection unit 70.

The coupler 80 includes a plurality of coupling pipes 81 (see FIG. 2) corresponding to the air inlet pipes 51, and constitutes a coupling head corresponding to the connecting head formed by the connector 50.

Figure 2:
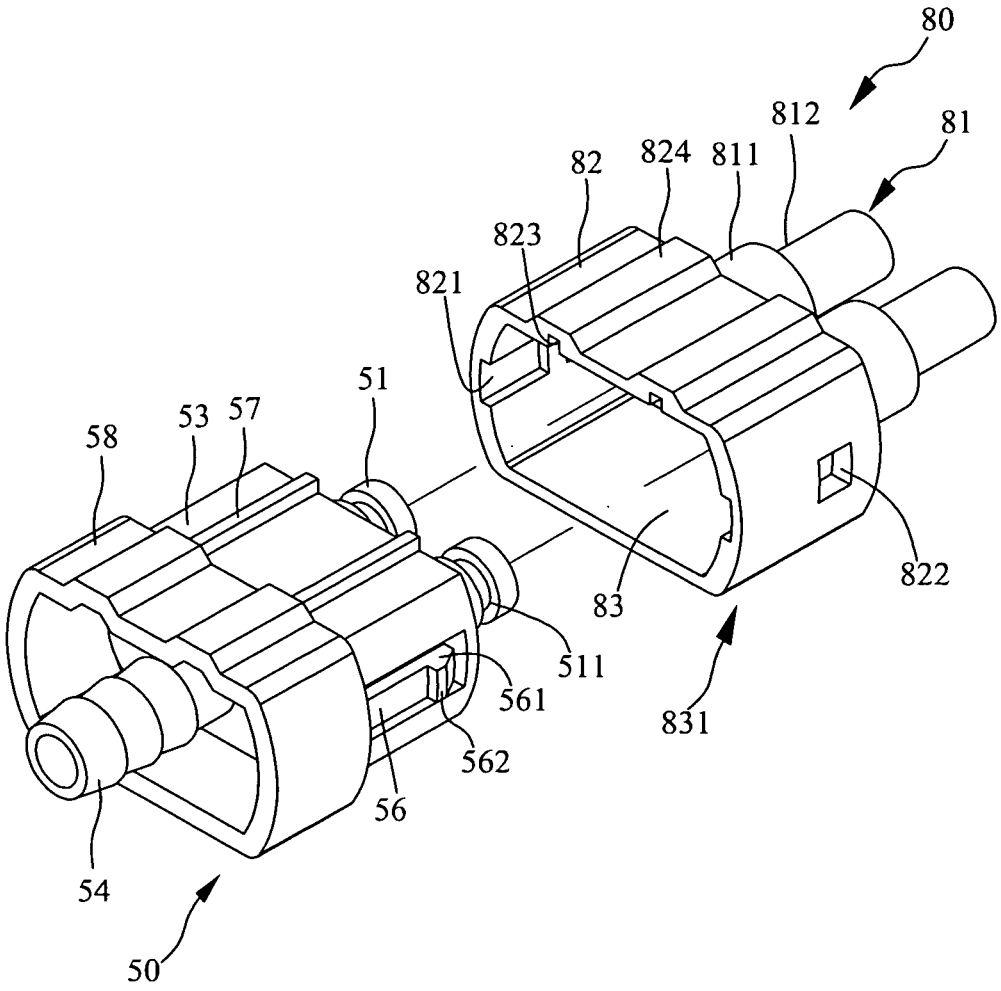
FIG. 2 is a perspective view showing a connector and a coupler included in the system of the present invention.
Figure 3:
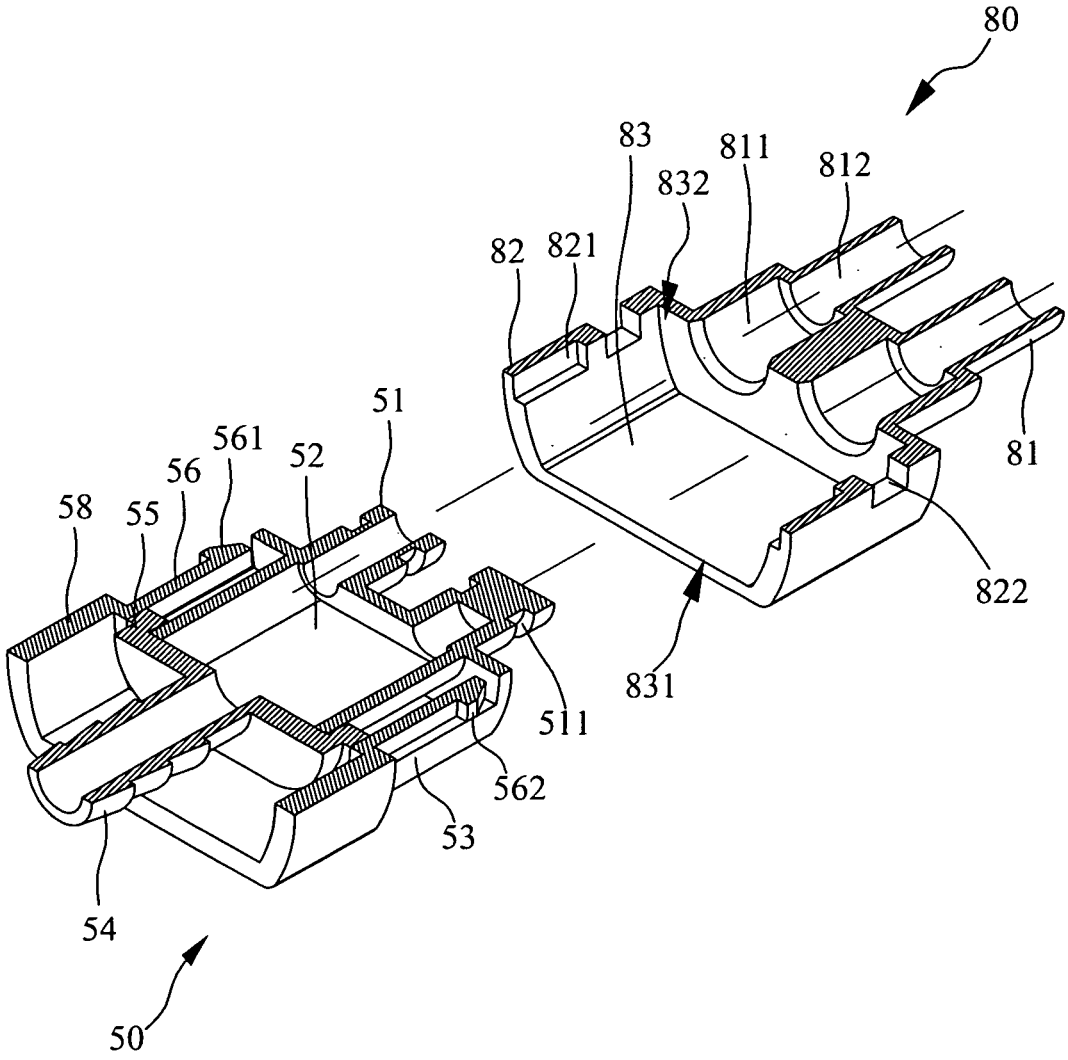
FIG. 3 is a sectional perspective view of FIG. 2.

Please refer to FIGS. 2 and 3, which are perspective view and sectional perspective view, respectively, showing the connector 50 and the coupler 80. The connector 50 includes a housing member 53 internally defining an air space 52, and the above-mentioned air inlet pipes 51 are located at one axial end of the housing member 53 to communicate with the air space 52. A cap 55 having an air outlet pipe 54 is covered onto another axial end of the housing member 53, so that air supplied into the air space 52 can flow out of the air space 52 only via the air outlet pipe 54.

The coupler includes a chamber 82 shaped corresponding to the housing member 53 for holding the latter therein. The chamber 82 internally defines a receiving space 83, of which two axial ends respectively form an open end 831 and a fixing end 832. The above-mentioned coupling pipes 81 are spaced on the fixing end 832 to communicate with the receiving space 83 and allow the air inlet pipes 51 to insert therein. The coupling pipes 81 respectively have a diameter-expanded seat section 811 and a diameter-reduced air path section 812. The seat section 811 is located between the receiving space 83 and the air path section 812 for the air inlet pipes 51 of the connector 50 to fit therein. The air inlet pipes 51 are provided on around respective distal end with an annular groove 511 for receiving a sealing element therein. The sealing elements can be, for example, rubber O-rings.

The housing member 53 of the connector 50 is further provided on two axial lateral outer surfaces with an elongated retaining arm 56 each. The retaining arms 56 respectively have a proximal end connected to the lateral outer surface of the housing member 53 and a free distal end formed into a hook portion 561 and a push portion 562. On the other hand, the chamber 82 in the coupler 80 has a channel 821 and a retaining hole 822 sequentially provided on each of two axial lateral inner surfaces thereof at positions corresponding to a linear path along which the retaining arm 56 is moved into the coupler 80 from the opening end 831 of the chamber 82. Whereby, when the connector 50 is fitted in the chamber 82, the retaining arms 56 are moved through the two channels 821 with the hook portions 561 and the push portions 562 extending into and becoming engaged with the retaining holes 822. With these arrangements, an enhanced connecting force between the connector 50 and the coupler 80 can be ensured. At this point, the air inlet pipes 51 with the sealing elements mounted thereon are simultaneously extended into the seat sections 811 of the coupling pipes 81, allowing the connector 50 to couple and communicate with the coupler 80.

Figure 4:
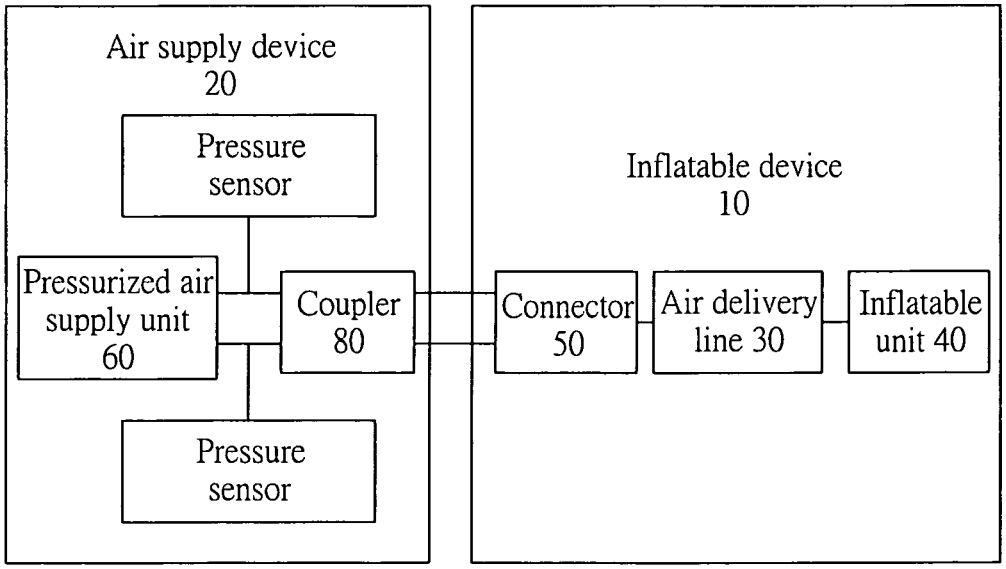
FIG. 4 is another block diagram of the system for detecting and determining the type of an inflatable device being coupled with an air supply device according to the present invention.

Referring to FIGS. 3 and 4 at the same time. In the illustrated embodiment of the present invention, there are two coupling pipes 81 provided on the coupler 80 for coupling with two air inlet pipes 51 on the inflatable device 10. Wherein, one of the two air inlet pipes 51 is a blocked air inlet pipe 51 having a sealed distal end while the other air inlet pipe 51 is an open pipe having an open distal end. The pressure detection unit 70 includes a pressure sensor installed in each of the coupling pipes 81 for sensing an internal pressure of the coupling pipe 81. From the sensed internal air pressures of the coupling pipes 81, it is able to detect whether the coupling pipes 81 are fluidly communicable with the air inlet pipes 51 and accordingly further detects a relative position of the blocked air inlet pipe 51 on the connector 50. Further, from the relative position of the blocked air inlet pipe 51 on the connector 50, the pressure detection unit 70 is able to determine the type of the inflatable unit 40 being used with the connector 50 and then directly controls the pressurized air supply unit 60 of the air supply device 20 to output a corresponding air flow for the inflatable unit 40 to have a proper internal air pressure to exactly provide the function of massaging and exercising the muscles at a specific area on a patient's body.

Figure 5:
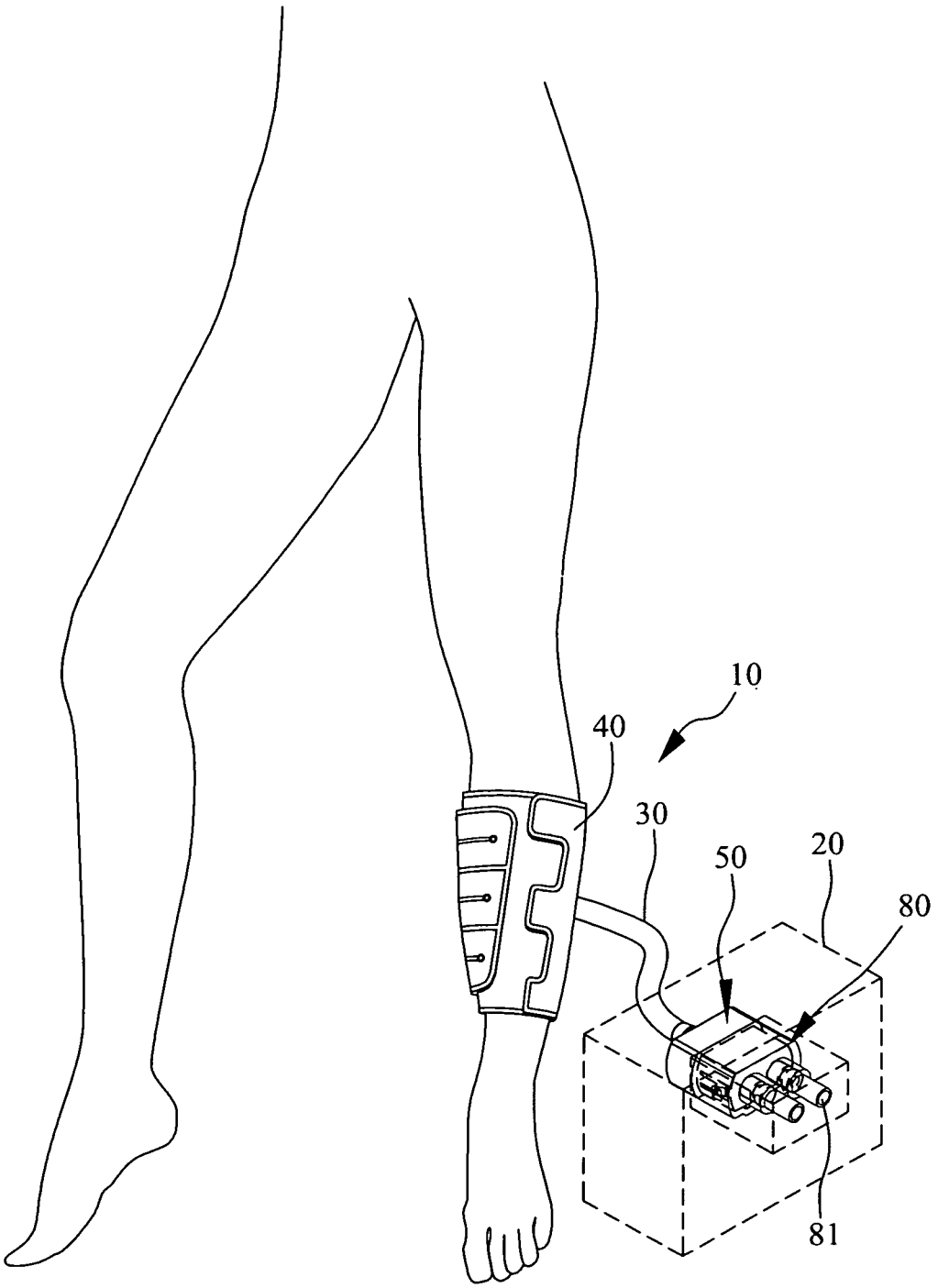
FIG. 5 illustrates the use of a first embodiment of the present invention.

FIG. 5 pictorially shows a first embodiment of the present invention, according to which two air inlet pipes 51 are provided on a left and a right side of the connector 50. When the connector 50 is inserted into the coupler 80 in a predetermined direction, the left pressure sensor would detect a larger pressure value while the right pressure sensor would detect a smaller pressure value. Thus, the pressure detection unit 70 determines the left air inlet pipe 51 is in a blocked state and the right one is in an open state, and accordingly, further determines the inflatable unit 40 currently coupled with the air supply device 20 and the coupler 80 via the connector 50 is a type of inflatable unit 40 for use with a user's calf. Based on the detection result, air having a pressure value preset in the pressurized air supply unit 60 and suitable for massaging or exercising the calf muscles is supplied from the pressurized air supply unit 60 to inflate the inflatable unit 40, enabling the latter to properly massage or exercise the user's calf muscles to help in improving the calf's blood circulation.

Figure 6:
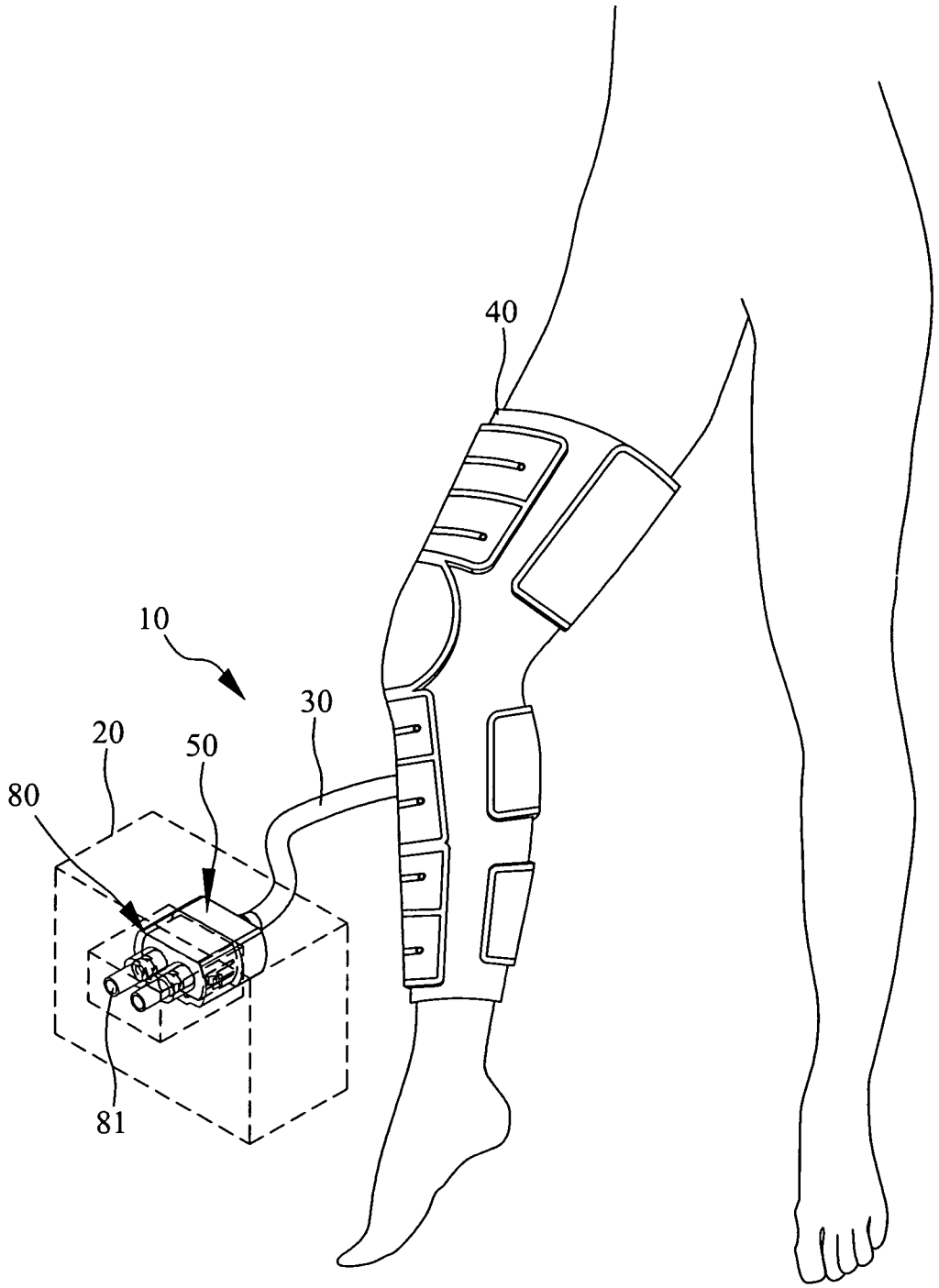
FIG. 6 illustrates the use of a second embodiment of the present invention.
Figure 7:
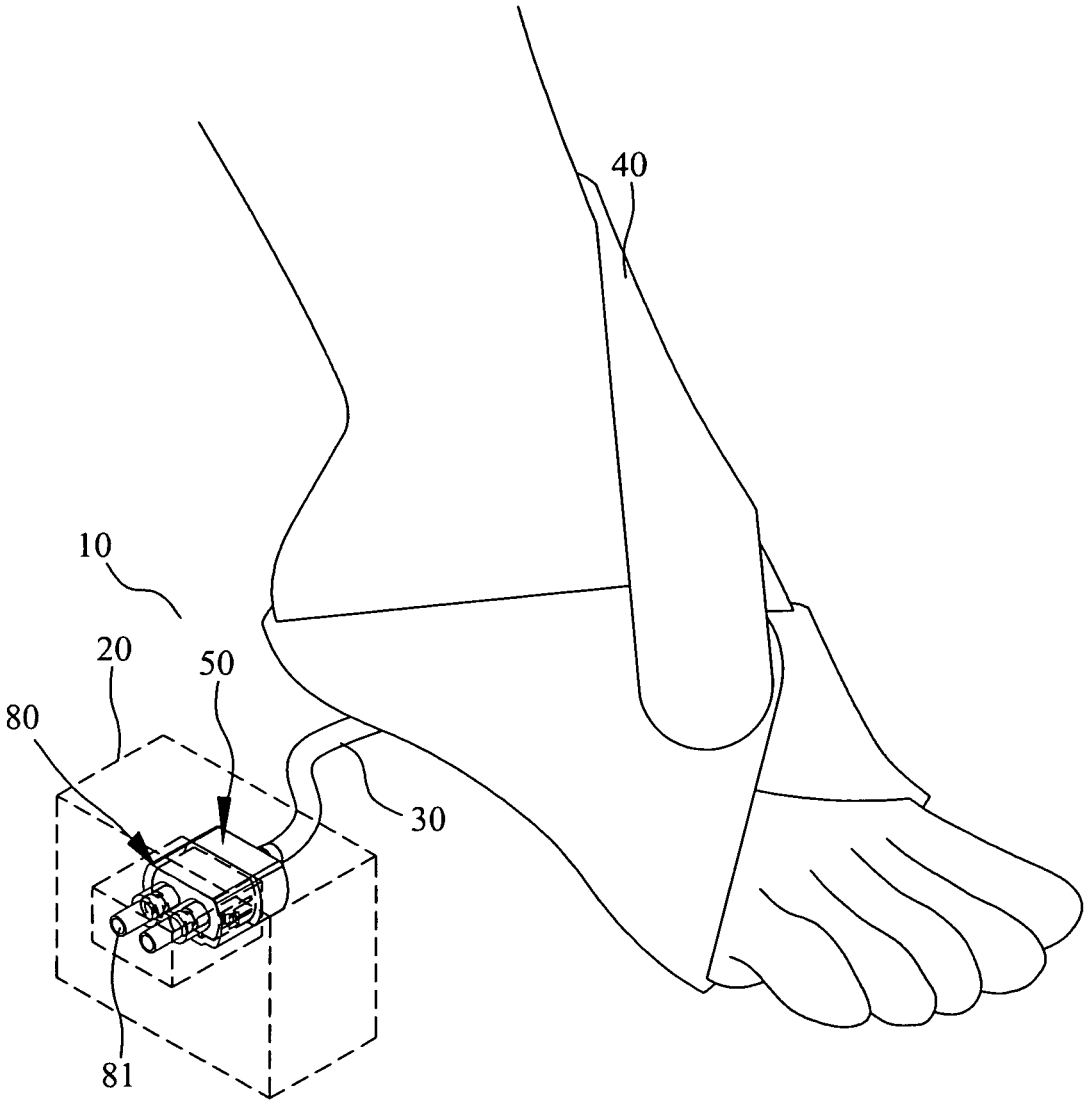
FIG. 7 illustrates the use of a third embodiment of the present invention.

FIG. 6 pictorially shows a second embodiment of the present invention. When the coupler 80 of the air supply device 20 is coupled with the connector 50 of the inflatable device 10, the air supply device 20 is fluidly communicable with the inflatable unit 40 for supplying air to inflate the inflatable unit 40. In the process of inflating the inflatable unit 40, the left pressure sensor of the pressure detection unit 70 would detect the air pressure in the left air inlet pipe 51 and the left coupling pipe 81, and the right pressure sensor of the pressure detection unit 70 would detect the air pressure in the right air inlet pipe 51 and the right coupling pipe 81. In this second embodiment, since the right air inlet pipe 51 is configured as a blocked pipe and the left air inlet pipe 51 is an open pipe, the right pressure sensor of pressure detection unit 70 would detect a larger pressure value while the left one would detect a smaller pressure value. The pressure detection unit 70 then compares the detected result with preset values and controls the air volume to be supplied by the air supply device 20, so that the air pressure in the inflatable unit 40 is regulated to a level most suitable for massaging and exercising all the leg muscles, enabling the inflatable unit 40 to massage and exercise the user's leg muscles to improve the whole leg's blood circulation. FIG. 7 pictorially shows a further embodiment of the present invention for massaging and exercising the user's foot, particularly the user's foot sole, to help in the sole's blood circulation.

Please refer to FIGS. 2 and 3 again. According to the present invention, the pressure detection unit 70 determines the type of the inflatable device 10 by detecting the relative position of the blocked air inlet pipe 51 on the connector 50 after the connector 50 is inserted in the coupler 80. For this purpose, the connector 50 can be only fitted one way into the coupler 80. To ensure that the connector 50 only fits one way, in the pictorially illustrated embodiments of the present invention, the housing member 53 is provided on one outer surface with at least one guide rail 57, and the chamber 82 is provided on a corresponding inner surface with a guide groove 823 for correspondingly engaging with the guide rail 57, so that the connector 50 can be coupled with the coupler 80 only when the connector's outer surface with the at least one guide rail 57 is oriented to the chamber's inner surface with the corresponding guide groove 823.

Further, for the user to directly recognize from the outer surfaces of the connector 50 and the coupler 80 the only correct fitting direction without the need of checking the positions of the guide rail 57 and the guide groove 823, the chamber 82 further has a raised portion 824 formed on an outer surface thereof corresponding to each guide groove 823 provided on the chamber's inner surface, and the housing member 53 of the connector 50 further has an extended portion 58 formed on around an axial end adjacent to the air outlet pipe 54.

The above described means for increasing the connecting force between the connector 50 and the coupler 80, and means for recognizing the only correct fitting direction of the connector 50 into the coupler 80 are only illustrative to enable easy explanation of the present invention and not intended to limit the present invention in any way. That is, all other means that enable increased connecting force between the connector and the coupler and all other means that enable easy recognition of the correct fitting direction of the connector into the coupler are included in the scope of the present invention.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A system comprising:

an inflatable device including an air delivery line having two opposite ends, an inflatable unit connected to one end of the air delivery line, and a connector connected to the other end of the air delivery line, the connector having a plurality of air inlet pipes; and an air supply device including a pressurized air supply unit, a pressure detection unit, and a coupler adapted to connect with the pressurized air supply unit and the pressure detection unit, the coupler including a plurality of coupling pipes corresponding to the air inlet pipes and one of the air inlet pipes of the connector being blocked while all of the other air inlet pipes are open, wherein a position of the blocked air inlet pipe is relative to all of the open air inlet pipes of the connector and indicates the type of the inflatable unit connected to the connector via the air delivery line, and the pressure detection unit detects the position of the blocked air inlet pipe of the connector, by sensing an internal air pressure of the coupling pipes, to determine the type of the inflatable unit of the inflatable device coupled with the air supply device.

2. The system as claimed in claim 1, wherein the connector further includes:

a housing member defining an air space that is communicable with the air inlet pipes, the air inlet pipes being disposed at an axial end of the housing member; and an air outlet pipe disposed at another axial end of the housing member to connect with the other end of the air delivery line.

3. The system as claimed in claim 2, wherein the connector further includes a cap including the air outlet pipe, the cap being disposed on the other axial end of the housing member, so that air supplied into the air space can flow out of the air space via the air outlet pipe.

4. The system as claimed in claim 2, wherein the coupler further includes a chamber having a shape configured to hold the housing member, the chamber defining a receiving space having two axial ends respectively defining an open end and a fixing end, and the coupling pipes being disposed on the fixing end of the receiving space.

5. The system as claimed in claim 2, wherein the housing member is disposed on an outer surface of the connector and has a guide rail, and the chamber is disposed on an inner surface of the coupler and has a guide groove configured to engage with the guide rail.

6. The system as claimed in claim 2, wherein the housing member includes an axial lateral outer surface having an elongated retaining arm;

the retaining arm having a proximal end connected to the axial lateral outer surface of the housing member, and a free distal end having a hook portion and a push portion; and the chamber having a channel and a retaining hole, which are disposed on the axial lateral inner surface at a position corresponding to a linear path along which the retaining arm is moved into the coupler.

7. The system as claimed in claim 2, wherein each of the air inlet pipes have an end with an annular groove.

8. The system as claimed in claim 5, wherein the chamber further includes a raised portion disposed on an outer surface of the chamber, the raised portion corresponding to the guide groove of the inner surface of the chamber, and the housing member further includes an extended portion disposed on the other axial end.

9. The system as claimed in claim 4, wherein each of the coupling pipes have a diameter-expanded seat section and a diameter-reduced air path section.

10. The system as claimed in claim 1, wherein the pressurized air supply unit supplies air to the inflatable unit through the open air inlet pipes to reach a specific air pressure according to the type of the inflatable unit determined by the pressure detection unit.

11. The system as claimed in claim 2, wherein the inflatable device further includes a plurality of the air delivery lines, the inflatable unit is connected to one end of each of the air delivery lines, and the connector is connected to the other end of each of the air delivery lines.

12. The system as claimed in claim 11, wherein the connector further includes a plurality of air outlet pipes disposed at the other axial end of the housing member, and each of the air outlet pipes being configured to connect with one of the air delivery lines.

13. A system comprising:

an inflatable device including an air delivery line having two opposite ends, an inflatable unit connectable to one end of the air delivery line, and a connector connectable to the other end of the air delivery line, the connector having a plurality of air inlet pipes; and an air supply device including a pressurized air supply unit, a pressure detection unit, and a coupler connectable with the pressurized air supply unit and the pressure detection unit, the coupler including a plurality of coupling pipes corresponding to the air inlet pipes, and one of the air inlet pipes being blocked while another of the air inlet pipes is open, wherein the pressure detection unit is configured to detect a position of the blocked air inlet pipe by sensing an internal air pressure of the coupling pipes, the position of the blocked air inlet pipe indicating the type of the inflatable unit connected to the connector via the air delivery line, and determine the type of the inflatable unit coupled with the air supply device from the detected position of the blocked air inlet pipe.

* * * * *